US006094008A

United States Patent [19]

Omori et al.

[11] Patent Number: 6,094,008

[45] Date of Patent: Jul. 25, 2000

[54] DISCHARGE LAMP FOR AN AUTOMOTIVE VEHICLE

[75] Inventors: Shinya Omori, Yokohama; Takashi Futami, Tokyo; Yasuhisa Yaguchi, Sagamihara; Masaaki Muto, Kawasaki, all of Japan

[73] Assignee: Stanley Electric Co., Ltd., Japan

[21] Appl. No.: 09/013,424

[22] Filed: Jan. 16, 1998

[30] Foreign Application Priority Data

Jun. 6, 1997 [JP] Japan ..... 9-149411

[51] Int. Cl.[7] ..... H01J 61/35

[52] U.S. Cl. ..... 313/634; 313/25; 313/573

[58] Field of Search ..... 313/25, 26, 634, 313/570, 573

[56] References Cited

U.S. PATENT DOCUMENTS

| | | | |
|---|---|---|---|
| 3,867,661 | 2/1975 | Waltz et al. | 313/26 |
| 4,594,529 | 6/1986 | De Vrijer | 313/634 |
| 5,646,471 | 7/1997 | Scholler et al. | 313/634 |
| 5,736,811 | 4/1998 | Westmeyer et al. | 313/634 |

FOREIGN PATENT DOCUMENTS

| | | |
|---|---|---|
| 19613468A1 | 10/1996 | Germany . |
| 2-168550 | 6/1990 | Japan . |
| 2-168551 | 6/1990 | Japan . |
| 2281148 | 2/1995 | United Kingdom . |
| WO97/458859 | 4/1997 | WIPO . |

*Primary Examiner*—Ashok Patel

*Attorney, Agent, or Firm*—Ostrolenk, Faber, Gerb & Soffen, LLP

[57] ABSTRACT

A discharge lamp for an automotive vehicle including a discharge bulb and an outer cover tube for covering the discharge bulb. The discharge bulb is composed of a discharge chamber portion, a pair of seal portions for sealing both ends of the discharge chamber portion, and a pair of discharge electrodes held in respective ones of the seal portions. At the end of each seal portion adjacent to the discharge chamber portion, a taper portion is provided, which is narrowest near the discharge chamber portion, and which defines an angle with respect to a tube axis of the discharge bulb of 45 degrees or less. A curvature of a tube wall of the discharge chamber portion, is substantially constant. A ratio of the minimum thickness to the maximum thickness of the tube wall measured within that angle is between 1 and 0.8. The discharge bulb and the outer cover tube are in contact, with the portion of said discharge chamber portion having the maximum outer diameter being in contact with the outer cover tube.

3 Claims, 2 Drawing Sheets

DISCHARGE LAMP FOR AN AUTOMOTIVE VEHICLE

BACKGROUND OF THE INVENTION

1. Field of the Invention

The present invention relates to a discharge lamp and particularly to a structure of a discharge lamp suitable for use as a light source in lighting equipment such as a head lamp, a fog lamp and the like for an automotive vehicle.

2. Background Art

An embodiment of a structure of a conventional discharge lamp 90 for an automotive vehicle is shown in FIGS. 4 and 5. The discharge lamp 90 for an automotive vehicle is constituted by a discharge bulb 91, an outer cover tube 95 and a socket 96 for mounting the discharge lamp to a lighting device for an automotive vehicle (not shown). In this case, FIG. 4 shows a cross section in a vertical direction with the discharge lamp 90 mounted to the automotive vehicle (not shown), and FIG. 5 shows a cross section in a horizontal direction.

In this case, the discharge bulb 91 comprises a discharge chamber portion 91*a* and a seal portion 91*b*, as shown in FIG. 5. The discharge chamber portion 91*a* has a contour of a substantially spherical shape or a substantially cylindrical shape and is provided with a space for containing the discharge therewithin. The seal portion 91*b* is provided with discharge electrodes 92, a molybdenum foil 93 and a lead wire 94. The discharge electrodes 92 are held so as to oppose each other within the discharge chamber portion 91*a* with a suitable interval and electric power can be supplied to the discharge electrodes 92 from an outer portion.

Since the discharge bulb 91 is covered by the outer cover tube 95 (refer to FIG. 4), the discharge bulb 91 is prevented from being cooled by the open air and the like, which would reduce its efficiency. With the cover tube 95, it maintains a suitable temperature, thereby preventing a reduction its luminous efficiency. In most cases, a shield film 95*a* for shielding a portion which generates a harmful light such as a dazzling light and the like is provided when assembling the discharge lamp 90 to the automotive vehicle, on surface of the outer cover tube 95.

When the electric power is supplied to the discharge lamp 90 for the automotive vehicle having the above structure, the discharging is performed between the discharge electrodes 92, so that a noble gas such as xenon gas and the like and a metal halide such as scandium and the like sealed within the discharge chamber portion 91*a* emit light. Accordingly, for example, a white light having a color temperature near 4800° K is emitted, and for example, which is excellent for color rendering in comparison with a light having a color temperature near 2800° K, which can be obtained with a filament type lamp such as a halide electric lamp and the like.

However, in the conventional discharge lamp 90 mentioned above, since a non-evaporated metal halide H is mounted to a lower portion within the discharge chamber portion 91*a* extending over a relatively wide area (refer to FIG. 4), a light passing through the portion from an arc K, that is, a downward light, generates coloration and diffusion.

In this case, generally, since the lamp is vertically and laterally inverted after when being assembled in the lamp equipment for the automotive vehicle and its light is reflected in a reflecting mirror, the downward light passing through the non-evaporated metal halide mentioned above is directed upward light so as to cause an undesirable dazzling.

In order to avoid this problem, a light distribution characteristic of the light equipment is generally made downward. However in this case, the light can not reach far, so that there is a problem that a distant visibility is reduced.

Further, secondly, when the seal portion 91*b* is formed in the conventional discharge lamp 90 for the automotive vehicle, only heating and pressing are performed and the shape of the seal portion 91*b* obtained thereby is not controlled, so that the curvature suddenly changes at a connecting portion 91*c* with respect to the discharge chamber portion 91*a*, so that a shining light spot L is generated near the connecting portion 91*c*, which gives the appearance that a plurality of light sources exist (refer to FIG. 5). Accordingly, there occurs a problem that it is difficult to form the light distribution characteristic that is needed in the light equipment for the automotive vehicle.

Still further, thirdly, the shape of the discharge chamber portion 91*a* is not sufficiently considered from an optical point of view. For example, in most cases, the thickness is suddenly changed at a portion near the seal portion 91*b* of the discharge chamber portion 91*a*, so that the light passing through the portion from the arc K receives an optical distortion such as a refraction and a change of shape. Accordingly, there occurs a problem that it is difficult to form the light distribution characteristic, as mentioned above. Accordingly, an object of the present invention is to solve the above problems.

SUMMARY OF THE INVENTION

In order to solve the above conventional problems, in accordance with the present invention, there is provided a discharge lamp for an automotive vehicle comprising a discharge bulb constituted by a discharge chamber portion forming a space wherein a discharge takes place and a pair of seal portions for sealing both ends of the discharge chamber portion and for holding discharge electrodes within the discharge chamber portion in an opposing manner. An outer cover tube covers the discharge bulb. A narrow taper portion adjacent to the discharge chamber and forms an angle with respect to a tube axis of the discharge bulb which is equal to or less than 45 degrees, in each of the portions of the seal portion, close to the discharge chamber. The tube wall of the discharge chamber portion is structured with a substantially constant radius of curvature in a cross section thereof taken along the tube axis, within a range of 45 degrees on both sides of a plane perpendicular to the tube axis at a central position of the discharge chamber portion. Also, a ratio of the minimum value with respect to the maximum value of the tube wall thickness, measured in a direction as seen from the central position, is set within the range between 1 and 0.8. The discharge bulb and the outer cover tube are in contact, at the portion having the maximum outer diameter of the discharge chamber portion, in the portion that is lowermost when the discharge lamp is in use on an automotive vehicle.

BRIEF DESCRIPTION OF THE DRAWINGS

These objects and advantages of the present invention will become clear from the following description with reference to the accompanying drawings, wherein.

DETAILED DESCRIPTION OF THE PREFERRED EMBODIMENTS

Figure 1:
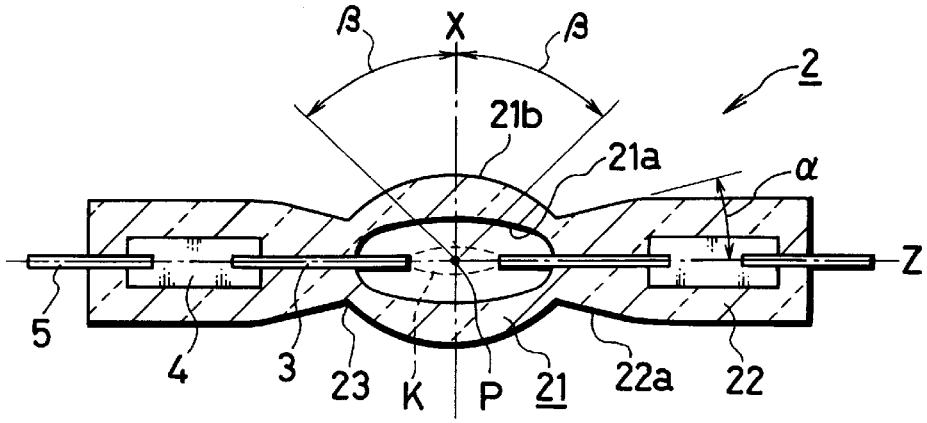
FIG. 1 is a horizontal cross sectional view which shows a main part of an embodiment of a discharge lamp for an automotive vehicle in accordance with the present invention.

Embodiments in accordance with the present invention will be explained in detail below with reference to the accompanying drawings. FIG. 1 shows a discharge bulb 2 of a discharge lamp 1 for an automotive vehicle in accordance with the present invention, and shows a horizontal cross section in a state of mounting to the automotive vehicle. In the present invention, the discharge bulb 2 is formed of a discharge chamber portion 21 and a pair of seal portions 22 provided at both ends thereof. Each seal portion 22 is provided with a discharge electrode 3, a molybdenum foil 4 and a lead wire 5 in the same manner as that of the conventional one.

In accordance with the present invention, the shapes of the discharge chamber portion 21 and the seal portion 22 are defined. Each of the seal portions 22 is provided with a taper portion 22*a* which has a narrow portion at the end of the discharge chamber portion 21 and defines an angle $\alpha$ with respect to a tube axis Z of the discharge bulb 2 equal to or less than 45 degrees (preferably equal to or less than 20 degrees) in a portion close to the discharge chamber portion 21.

To form the taper portion 22*a*, in the conventional method, the corresponding portion is held between metal molds and the like from both directions and is heated so as to be softened. In order to control the shape of the taper portion after molding, according to the embodiments of the invention, the metal mold is formed to a suitable shape, so as to make the shape at a time of being molded constant.

In the embodiments, the taper portion 22*a* is provided for the purpose of preventing a sudden change of the curvature in a connecting portion 23 between the discharge chamber portion 21 and the seal portion 22, thereby preventing the portion from shining. Accordingly, with respect to the molding direction in which the sudden change of the curvature is not generated, that is, the vertical cross sectional direction (in which the lamp is mounted to the automotive vehicle) shown in FIG. 2, the formation of the taper portion may be omitted.

Further, in accordance with the present invention, with respect to the discharge chamber portion 21, by specifying the curvature and the thickness, an optical distortion which the light receives when the light from the arc K passes through the discharge chamber portion 21 is reduced. In this case, as a result of measurements by the inventor for achieving the present invention, it has been ascertained that the discharge of the light in this type of discharge lamp 1 for the automotive vehicle is concentrated in a range in which an angle $\beta$ with respect to a plane X perpendicular to the tube axis Z as seen from the position of the center P of the discharge chamber portion 21 becomes 45 degrees.

Accordingly, the specification of the shape in the discharge chamber portion 21 can be limited to the range of the angle $\beta$ mentioned above, so that the present invention makes the radius of curvature of the cross section coinciding with the tube axis Z of the tube wall in the range substantially equal or no curvature, that is, close to a circular arc shape or a linear shape in both an inner surface 21*a* and an outer surface 21*b*, thereby passing through in a constant condition.

In addition to this, a ratio of the minimum value of the thickness of the tube wall measured in a direction as seen from the position of the center P within the above range with respect to the maximum value thereof is set to be in a range from 1 to 0.8. In this case, the position showing the maximum value of the thickness of the tube wall may coincide with the plane X perpendicular to the tube axis Z, or may coincide with a position 45 degrees from the plane X. In either case, it is sufficient if the ratio between the minimum and maximum values is within the range mentioned above.

Figure 2:
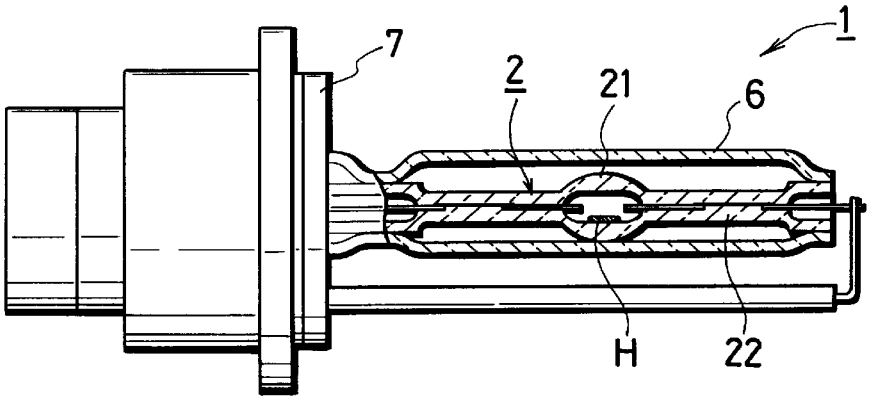
FIG. 2 is a vertical cross sectional view which shows the same embodiment.

By constituting in the above manner, the discharge bulb 2 does not shine at a portion other than the arc K in the seal portion 22, and optical distortion such as enlargement, compression or curvature is avoided where the light from the arc K passes through the discharge chamber portion 21. Further, in addition to the above, the present invention can reduce the influence due to the non-evaporated metal halide material H, which is achieved by bringing the discharge bulb 2 into contact with the outer cover tube 6 at a predetermined position as shown in FIG. 2. In the drawing, reference numeral 7 denotes a socket.

FIG. 2 is a vertical cross-section of the discharge lamp 1 for the automotive vehicle 1 with the discharge lamp mounted to the automotive vehicle, in which the discharge bulb 2 and the outer cover tube 6 are in contact with each other in the lower portion and the place where those parts are in contact with each other is the lowermost end of the discharge bulb 2, that is, the portion in which the outer diameter of the discharge chamber portion 21 becomes maximum.

By structuring in the above manner, the portion being in contact with the outer cover tube 6 of the discharge chamber portion 21 radiates the heat to the open air through the outer cover tube 6 so that is kept at a relatively low temperature with respect to the other portions of the discharge chamber portion 21. Accordingly, the non-evaporated metal halide material H is disposed in the portion having the low temperature, concentrated in the narrow region close to the place being in contact with the outer cover tube 6. Accordingly, the portion of the light in which the coloration and diffusion are performed is reduced, thereby reducing the influence thereof.

In accordance with the a trial manufacture and an experiment by the inventor, when the metal halide material H is stored in the narrow region within the discharge chamber portion 21 as mentioned above, it has been ascertained that the shape and the size of the discharge chamber portion 21 relates thereto. Accordingly, in another embodiment shown in FIG. 3, by making the tube wall of the discharge chamber portion 21 thinner close to the seal portion 22 than at the center portion of the discharge chamber portion 21, the thinner portion becomes higher in temperature, so that the metal halide material H further concentrates in the center portion and is retained there.

Figure 3:
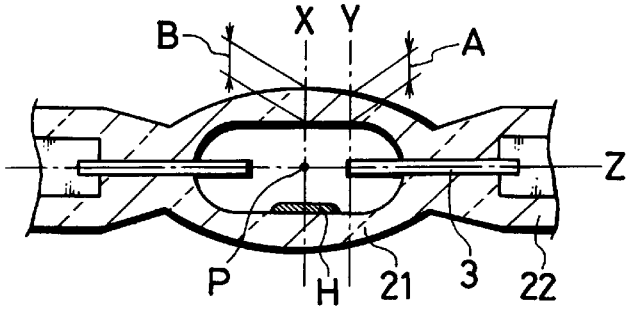
FIG. 3 is a cross sectional view which shows a main part of another embodiment of the discharge lamp for the automotive vehicle in accordance with the present invention.
Figure 4:
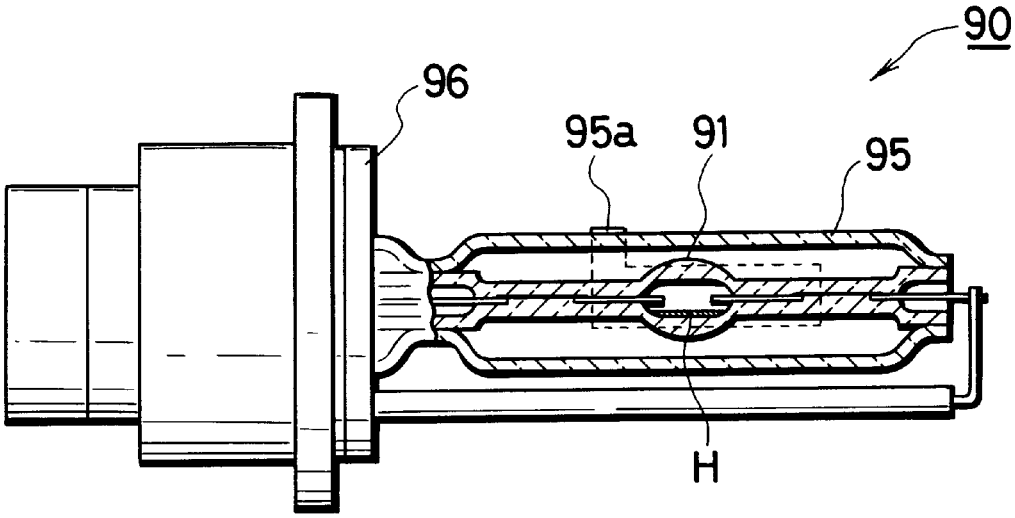
Fig. 4 Prior Art
FIG. 4 is a vertical cross sectional view which shows a conventional discharge lamp.
Figure 5:
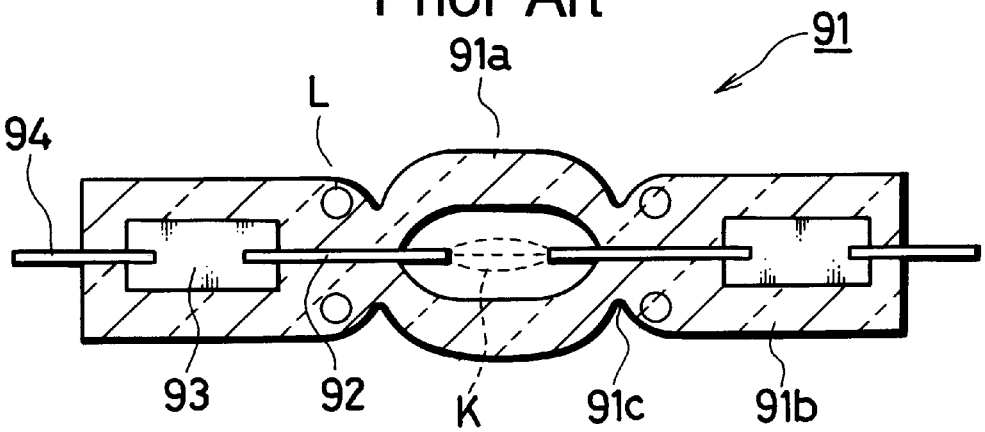
Fig. 5 Prior Art
FIG. 5 is a hroizontal cross sectional view which shows a main portion of the conventional discharge lamp.

The above feature of FIG. 3 will be described below with concrete values. When the thickness of the discharge chamber portion 21 crossing a plane Y passing through the front end of the discharge electrode 3 and perpendicular to the tube axis Z is A, and the thickness of the discharge chamber portion 21 crossing the plane X passing through the center P of the discharge chamber portion 21 and perpendicular to the tube axis Z is B, and $B/A \geqq 1.15$, it has been ascertained that the concentration of the metal halide material H can be further achieved. In this case, when the thickness A is set to be a value equal to or less than 0.8 mm, the mechanical strength of the discharge chamber portion 21 becomes insufficient, so that the thickness A is limited to be a value equal to or more than 0.8 mm.

Here, in accordance with the trial manufacture by the inventor when the above conditions exist in the discharge chamber portion 21, the range of the metal halide material H stored in the discharge chamber portion 21 when the lamp is lit becomes narrower than the distance between the opposing discharge electrodes 3 (about ⅔), so that influence on the passing light due to the coloration and diffusion can be further reduced.

In the embodiments of a discharge lamp for an automotive vehicle of the present invention described above in connection with FIGS. 1–3, the taper portion is provided in the portion of each of the seal portions close to the discharge chamber portion. Also, the discharge chamber portion is structured such that the curvature of the tube wall in the region within an angle 45 degrees to both sides from the plane perpendicular to the tube axis as seen from the position of the center of the discharge chamber portion is substantially constant, and the ratio of the minimum value of the thickness of the tube wall within the above range with respect to the maximum value thereof is set to be a value within the range from 1 to 0.8. Further, the discharge bulb and the outer cover tube are in contact with each other at the portion having the maximum outer diameter of the discharge chamber portion in the position which is lowermost in use. Thus, the other portion besides the arc portion are prevented from shining in the taper portion provided in the seal portion, by specifying the shape of the discharge chamber portion, so that the optical distortion when the light from the arc passes through the discharge bulb can be reduced, and by bringing the discharge bulb and the outer cover tube into contact with each other, the non-evaporated metal halide material can be concentrated in a narrow space. Accordingly, the light distribution of the discharge lamp for the automotive vehicle of this type can be improved.

While the presently preferred embodiment of the present invention has been shown and described, it will be understood that the present invention is not limited thereto, and that various changes and modifications may be made by those skilled in the art without departing from the scope of the invention as set forth in the appended claims.

What is claimed is:

1. A discharge lamp for an automotive vehicle comprising:

a discharge bulb comprising a discharge chamber portion forming a discharge space and a pair of seal portions which seal both ends of said discharge chamber portion respectively; said seal portions holding a respective pair of discharge electrodes in such a manner that they are opposed to each other for forming a discharge within said discharge space; and an outer cover tube covering said discharge bulb, wherein a taper portion is provided at an end of each said seal portion adjacent to the discharge chamber portion, said taper portion being narrowest near the discharge chamber portion, said taper portion defining an angle with respect to a tube axis of said discharge bulb equal to or less than 45 degrees;

wherein a curvature of a tube wall of said discharge chamber portion, in a cross section thereof along said tube axis, within a range of 45 degrees on both sides of a plane perpendicular to said tube axis at a central position of the discharge chamber portion, is substantially constant;

wherein a ratio of the minimum value with respect to the maximum value of a thickness of the tube wall measured within said range is between 1 and 0.8; and wherein said discharge bulb and said outer cover tube are in contact, with the portion of said discharge chamber portion having the maximum outer diameter being in contact with said outer cover tube.

2. A discharge lamp for an automotive vehicle according to claim 1, wherein when a wall thickness A of said discharge chamber portion at a plane passing through an end of one of said discharge electrodes and perpendicular to said tube axis, and a wall thickness B of said discharge chamber portion at a plane passing through the center of said discharge chamber portion and perpendicular to said tube axis, have the relationships $A \geqq 0.8$ mm and $B/A > 1.15$.

3. A discharge lamp for an automotive vehicle according to claim 2, wherein $A > 0.8$ mm.

* * * * *